US010376770B2

(12) United States Patent
Wittman

(10) Patent No.: US 10,376,770 B2
(45) Date of Patent: Aug. 13, 2019

(54) X SPLINT HAND PROTECTION DEVICE

(71) Applicant: XON Sports, Inc., Boulder, CO (US)

(72) Inventor: Trevor Gene Wittman, Golden, CO (US)

(73) Assignee: XON Sports, Inc., Boulder, CO (US)

( * ) Notice: Subject to any disclaimer, the term of this patent is extended or adjusted under 35 U.S.C. 154(b) by 147 days.

(21) Appl. No.: 15/469,543

(22) Filed: Mar. 26, 2017

(65) Prior Publication Data

US 2017/0282048 A1 Oct. 5, 2017

Related U.S. Application Data

(60) Provisional application No. 62/318,129, filed on Apr. 4, 2016.

(51) Int. Cl.
*A63B 71/14* (2006.01)
*A41D 19/00* (2006.01)
*A41D 19/015* (2006.01)

(52) U.S. Cl.
CPC ..... *A63B 71/145* (2013.01); *A41D 19/0013* (2013.01); *A41D 19/0048* (2013.01); *A41D 19/01523* (2013.01); *A41D 19/01558* (2013.01); *A41D 19/01582* (2013.01)

(58) Field of Classification Search
CPC ..... A41D 19/0013; A41D 19/0048; A41D 19/01523; A41D 19/01558; A41D 19/0006; A41D 19/01582; A41D 19/0034; A41D 19/01564; A41D 13/0568; A41D 13/081; A41D 13/088; A63B 71/145
USPC ..... 2/18, 159, 161.1
See application file for complete search history.

(56) References Cited

U.S. PATENT DOCUMENTS 3,944,220 A * 3/1976 Fasano ..... A63B 21/0552 482/47
4,748,690 A * 6/1988 Webster ..... A63B 71/143 2/161.1
5,004,227 A * 4/1991 Hoffman ..... A63B 21/065 2/159
5,004,231 A * 4/1991 Alread ..... A63B 21/4019 2/159
5,022,094 A * 6/1991 Hames ..... A41D 19/01547 2/159
5,864,884 A * 2/1999 Salvitti ..... A41D 19/01547 2/159

(Continued)

FOREIGN PATENT DOCUMENTS

EP 1700530 A1 * 9/2006 ..... A41D 19/01582
WO WO-9400030 A1 * 1/1994 ..... A63B 71/146

OTHER PUBLICATIONS

Prou Jean-Baptiste, EP1700530, Sep. 2006, translation via Espacenet Dec. 6, 2018.*

*Primary Examiner* — Clinton T Ostrup
*Assistant Examiner* — Patrick J. Lynch
(74) *Attorney, Agent, or Firm* — Neugeboren O'Dowd PC

(57) ABSTRACT

A striking glove may comprise an inner glove, an outer shell, and at least one strap at least partially disposed within a dorsal cavity between the inner glove and the outer shell. A portion of the at least one strap disposed within the dorsal cavity may be configured in an overlapped and crossed configuration. The ends of the at least one strap may extend from the dorsal cavity to an exterior of the striking glove.

16 Claims, 7 Drawing Sheets

(56) References Cited

U.S. PATENT DOCUMENTS

| | | | | |
|---|---|---|---|---|
| 5,887,282 | A * | 3/1999 | Lenhart | A41D 19/0037 2/159 |
| 6,202,213 | B1 * | 3/2001 | Georgick | A63B 71/145 2/161.1 |
| 6,286,148 | B1 * | 9/2001 | Meyer | A41D 19/0034 2/161.1 |
| 6,430,750 | B1 * | 8/2002 | Tourbier | A41D 19/001 2/159 |
| 6,430,751 | B1 * | 8/2002 | Tourbier | A41D 19/01582 2/159 |
| 7,275,267 | B2 * | 10/2007 | Thiruppathi | A41D 13/088 2/160 |
| 8,348,810 | B2 * | 1/2013 | Land | A63B 21/00065 482/47 |
| 8,726,418 | B2 * | 5/2014 | DeBlasis | A41F 1/06 2/161.1 |
| 2006/0149180 | A1 * | 7/2006 | Phelen | A61F 5/0118 602/20 |
| 2006/0205526 | A1 * | 9/2006 | Whitehead, II | A63B 71/148 473/59 |
| 2008/0000010 | A1 * | 1/2008 | Erickson | A41D 19/01547 2/161.6 |
| 2017/0215497 | A1 * | 8/2017 | Frederick | A41D 19/01582 |

* cited by examiner

X SPLINT HAND PROTECTION DEVICE

PRIORITY

This application claims priority to U.S. Provisional Application No. 62/318,129 filed Apr. 4, 2016, and entitled X SPLINT HAND PROTECTION DEVICE, which is incorporated herein by reference.

BACKGROUND

The unique complexity and functionality of the hand is what makes many of the tasks we perform on a daily basis seem simple, and to not require a second thought. It remains a secondary thought until you have an injury to your hand. Approximately 12% of all mixed martial arts (MMA) related injuries are to a participant's hands. An injury to one's hands can result in unwanted time away from training and potentially long term effects that could lead to limited ability to continue to participate in MMA related activities. The injuries to the hands and wrists not only involve breaks to the bones, but can also involve injuries to soft tissue around the hand and wrist. These soft tissue injuries also commonly require a longer time to recover.

There are several kinds of common hand and wrist injuries in striking sports. One common area for a striking athlete to injure his or her hand is at the level of the metacarpal phalangeal joint (MP joint). The MP joint is the 'large' joint of the fist that is the region in which a person strikes a target. There are two distinct anatomic tissues at risk during a strike in near the MP joint. The first are the sagittal bands. The sagittal bands are a set of tissues located on the dorsal aspect of the MP joint (back of the MP joint/extensor tendon side of the finger) that help to stabilize the extensor tendons from sliding from the ulnar or radial aspect of the MP joint during motion. These tissues can be partially or completely ruptured with a direct blow to them (i.e., punching something). If not treated, a tear can lead to continued pain in the region every time an athlete makes a fist or strikes. Treatment for this injury can include full-time use of a splint for 6 weeks or surgery, with at least 6 weeks off to recover, in more severe cases. The second region of concern are the collateral ligaments of the MP joint. The collateral ligaments function as ropes connecting the metacarpal head to the base of the proximal phalanx. The collateral ligaments act as soft tissue ties holding the joint together. They are located on the direct radial and ulnar aspect of the MP joint and are most often injured through hyperflexion (i.e., excessive bending forward into a closed hand position) or torsional stress to the MP joint.

Another common kind of striking injury is hyperextension of the wrist (i.e., extreme bending backward). Participants know that at times they can land an indirect strike that results in a hyperextension motion to the wrist that results in pain and discomfort. The pain caused by any of the aforementioned types of injuries can lead to frustration and cause athletes to stop participating in striking sports altogether.

Currently available boxing and striking gloves provide padding over the MP joint, as well as wrist support. However, existing gloves present several deficiencies. For example, gloves come in limited sizes, which are not always perfectly sized to a participant's hands. Any extra room in a glove may allow the fist to relax and consequently allow the metacarpal bones, thumb, or pinky to rest in a position where they are more prone to injury. Further, the interior of a glove may stretch over time, so even if the glove fits initially, its fit may deteriorate. Boxing gloves may typically be tightened around the wrist through laces, but this tightening does not increase support around the hands themselves. Participants often tape their hands and wrists before inserting them in gloves in order to prevent the aforementioned injuries. However, taping is time consuming and only tightens the hands and wrists themselves, which doesn't keep the glove itself tight to the hand and therefore, slippage within the glove remains a problem. Therefore, a need exists for boxing gloves that remedy these and other deficiencies.

SUMMARY

An aspect of the disclosure provides devices and methods to protect the hands of participants in training and competing in mixed martial arts (MMA), boxing and other sporting activities that involve striking objects or other participants with the hands.

In an embodiment, the present disclosure provides a striking glove that may comprise an inner glove, an outer shell, a first strap section and a second strap section, wherein the first strap section and the second strap section are disposed within a dorsal cavity between the inner glove and the outer shell in an overlapping and crossed configuration; and wherein the first strap portion and the second strap portion extend from the dorsal cavity to an exterior of the striking glove.

In an aspect of the disclosure, a striking glove may comprise an inner glove, an outer shell, and at least one strap at least partially disposed within a dorsal cavity between the inner glove and the outer shell. A portion of the at least one strap disposed within the dorsal cavity may be configured in an overlapped and crossed configuration. The ends of the at least one strap may extend from the dorsal cavity to an exterior of the striking glove.

In another aspect, a striking glove may comprise an inner glove, an outer shell, a first strap and a second strap, wherein the first strap and the second strap are disposed within a dorsal cavity between the inner glove and the outer shell in an overlapping and crossed configuration; and wherein the first strap and the second strap extend from the dorsal cavity to an exterior of the striking glove.

Another aspect of the disclosure provides a hand protection device which may comprise a glove having a dorsal side and a palmar side and configured to receive a hand. The hand protection device may further comprise a wrist band, at least two channels disposed on the dorsal side of the glove arranged in an overlapping and crossed configuration, and one or more straps disposed within the at least two channels. The one or more straps may be configured to be retained within and slide within the at least two channels. At least a portion of one of the one or more straps may cross over another portion of the one or more straps within the channel.

DETAILED DESCRIPTION

Throughout the present disclosure, the terms "X-splint", or "x-strap" may be used somewhat interchangeably refer to a feature of the disclosed device wherein two straps cross on the back, or dorsal side, of a hand forming a supportive structure that compresses the bones and soft tissues of the hand or foot of the wearer. "X-strap" may specifically refer to a strap or the configuration of one or more straps that tighten around a hand within the glove, and "X-splint" may specifically refer to the resulting splint-like orientation of the straps and the glove's other components once the one or more straps are secured in a desired place.

Figure 1:
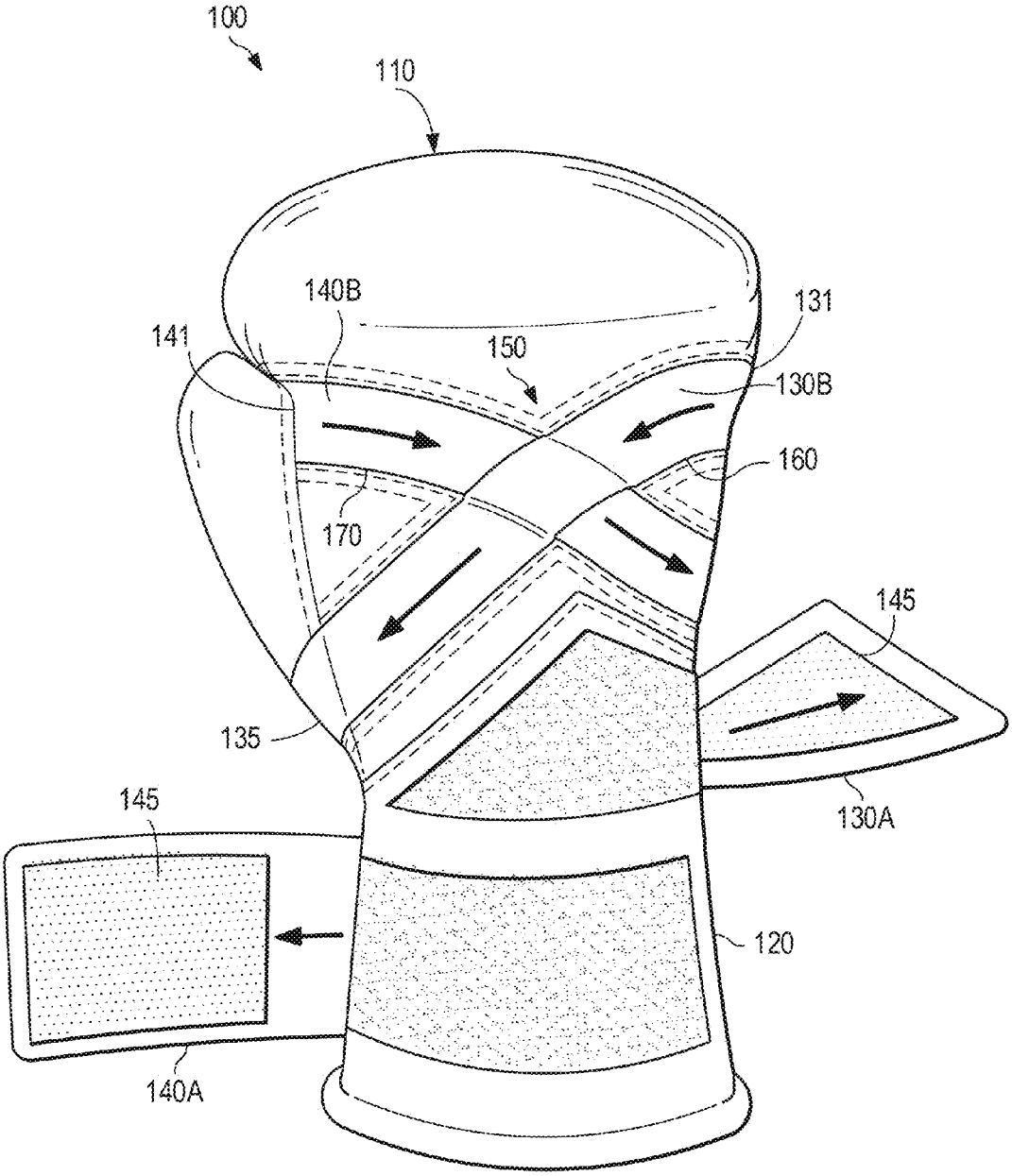
FIG. 1 provides a dorsal view of an embodiment of an "x-splint" protection glove of the current disclosure.
Figure 2:
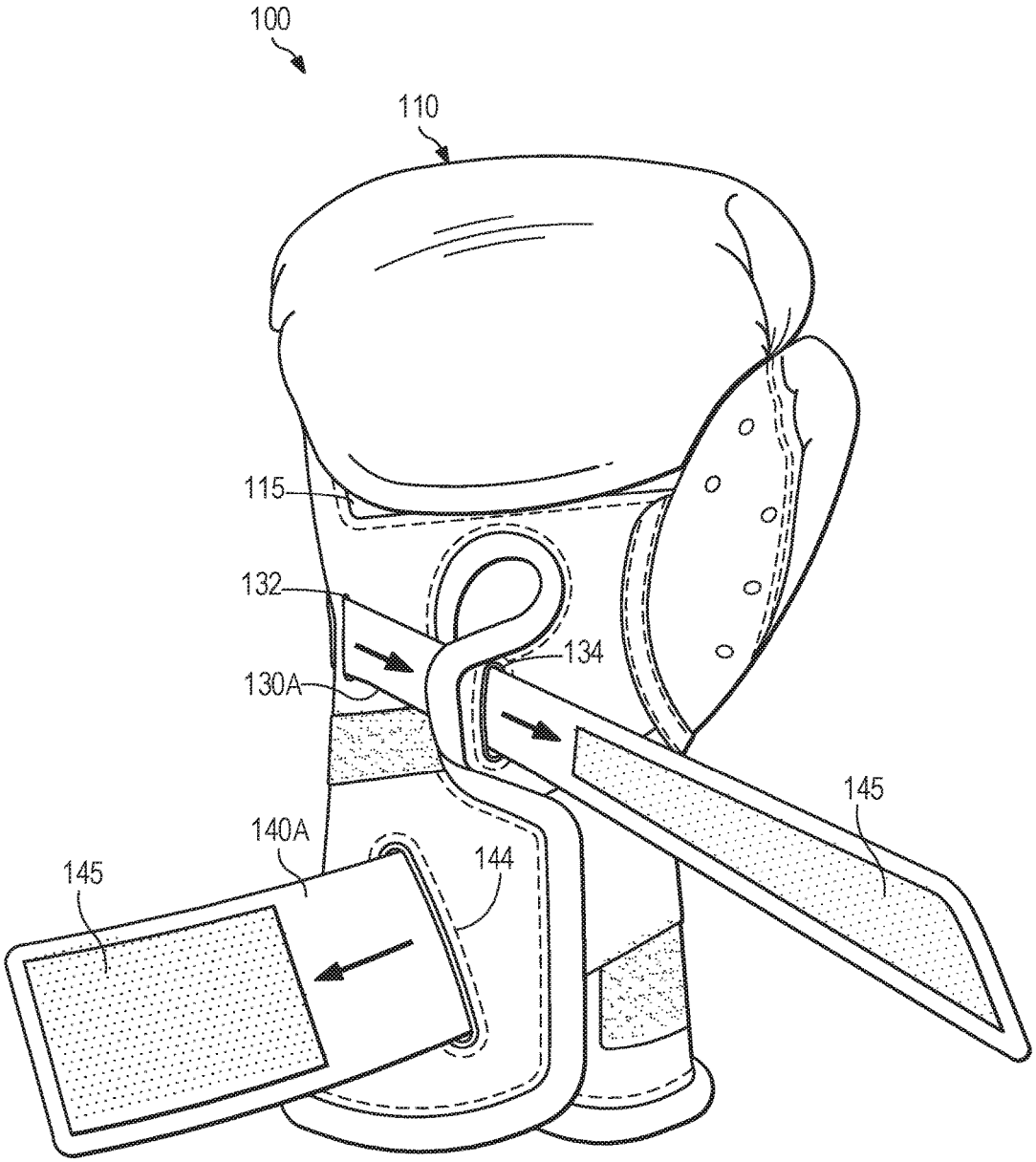
FIG. 2 provides a palmar view of an embodiment of the x-splint protection glove of the current disclosure.

An innovative aspect of the protective gloves of the present disclosure is the adjustable x-strap that allows the gloves to conform specifically to a particular user's hand size. Referring briefly to FIGS. 1 and 2, the external x-strap ends 130A and 140A, which exit and extend from a palmar side of the glove 100, may be pulled in opposite directions and secured to the wrist band 120. The pulling of the external x-strap ends 130A and 140A causes the internal x-strap portions 130B and 140B to tighten around the user's hand. In some embodiments, the x-strap may be formed from two or more separate straps, and in others, it may be formed from one contiguous strap.

When secured, the x-strap acts as an "x-splint" to compress the bones and soft tissues of the hand and wrist. This x-splint achieves several results. First, it creates a tightly fitted, yet comfortable glove, because the user may tighten it according to his or her preferences. The tight fit itself prevents sliding of the fist within the glove. Second, the improved fit results in fewer poorly positioned punches, allowing the athlete to land more technically clean strikes to help eliminate injury. Third, the x-splint design reduces injury to the hand and wrist of the participant due to a forced compression of the metacarpal bones, forced positioning of the wrist, and forced positioning of the thumb. In particular, the tightening of the x-splint causes the metacarpal bones, especially the most distal (pinky) metacarpal, to be compressed closer together than they would be in their natural fist position. This closer position of the metacarpals reduces the likelihood that a mispositioned blow would isolate the most distal metacarpal and cause injury. Regarding the wrist positioning, the x-splint tightening (in particular, the pulling of external x-strap end 140A forces the wrist to be angled slightly more proximally to the user's body than its natural position. As a result, the glove resists ulnar (i.e., towards the pinky finger) directed torsion of the wrist that can result in a wrist sprain or, more detrimentally, a tear to the triangular fibrocartilage complex of the wrist (TFCC). The TFCC is responsible for helping to provide stability between the radius and ulna at the level of the wrist and if torn can sometimes require surgical repair with up to 3-6 months to heal postoperatively.

The x-splint also positions the wrist in such a way as to help protect from a hyper extension injury. The x-splint that is formed when the x-straps are tightened force the user's wrist slightly downward, to reduce the likelihood that a misplaced blow on the underside of the fist does not cause the wrist to bend backward forcefully. Extreme, forceful wrist extension can lead to injuries in the wrist including scaphoid fractures, scapholunate ligament injuries, and dorsal triquetral avulsion fractures. Treatment for these conditions can range from 4 weeks in a cast to surgery and 6 months of recovery.

Other features of the x-splint gloves aim to decrease injuries to the collateral ligaments by providing a supportive buttress in the center of the hand to limit MP hyperflexion. This buttress is a hand grip, colloquially known as a 'roll of coins'. The hand grip not only helps to decrease hyperflexion of the MP joints, it indirectly decreases torsional stress to the MP joint by keeping all the neighbor MP joints and fingers in more anatomic alignment, which may prevent extreme ulnar or radial deviation. The x-splint glove of the present disclosure further help prevent external ulnar or radial deviation through its angular design in the striking surface to help the index and long finger make first solid contact during a strike.

Another aspect of the x-strap design of the present disclosure is that a portion of the strap may wrap around a thumb pocket of the glove, which pulls the thumb closer into the other fingers of the hand. This positioning of the thumb reduces the likelihood that a misplaced blow on the thumb region will result in a thumb dislocation, sprain, or break.

Figure 5:
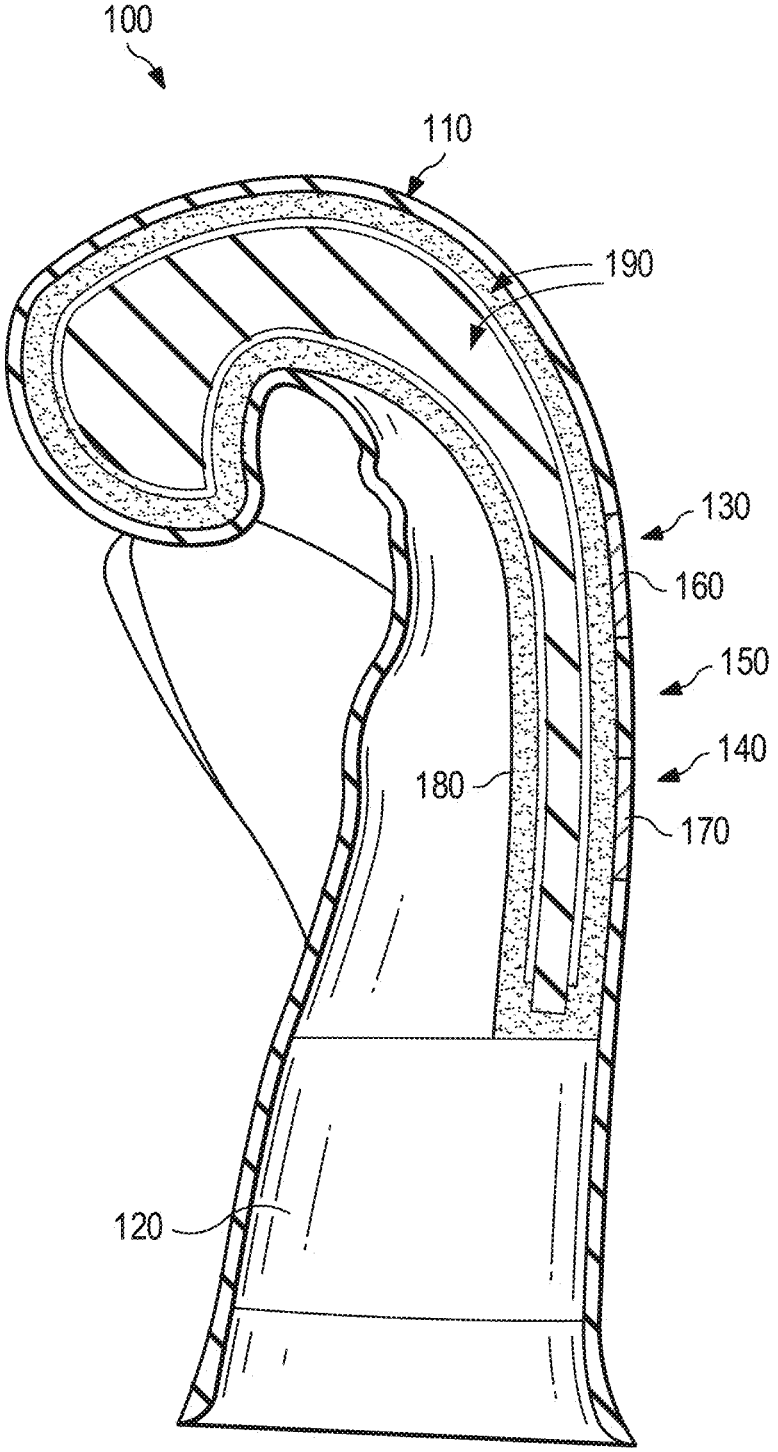
FIG. 5 provides a cutaway side view of an embodiment of the x-splint protection glove of the current disclosure.

An embodiment of the x-splint glove 100 is illustrated in FIG. 1. The x-splint protection device 100 may be disposed on the hand and wrist of a user to reduce risk of injury to the metacarpals, metacarpal phalangeal joint, and phalanges of the user. The glove 100 may comprise an inner glove (not shown in this view) having a principal pocket for receiving the user's wrist, metacarpals, metacarpal phalangeal joint, and phalanges and a second pocket for receiving the user's thumb. The inner glove may have a dorsal side and a palmar side and an exterior flexible shell 110 generally encompassing and secured to the inner glove with a space defined between corresponding parts of the inner glove and the exterior flexible shell. In some embodiments, the inner glove may be removable, as will be described in further detail later in this disclosure. The glove 100 shown comprises a wrist band 120, and the inner glove and exterior flexible shell 110 are configured to connect to the wrist band 120 (e.g., by stitching or unitary construction). Referring briefly to FIG. 5, the glove 100 may also comprise a dorsal pad 190 secured within the space defined between corresponding parts of the inner glove and the exterior flexible shell 110 for affording strike and shock protection to the dorsal surfaces of the user's wrist, metacarpals, metacarpal phalangeal joint, and phalanges. The dorsal pad 190 may comprise a plurality of layers. In the embodiment of FIG. 1, the first and second fasteners comprise hook-and loop attachments 145 In this figure, the first and second fasteners are not attached to the wrist band 120.

Referring to FIG. 2, the glove 100 may also comprise a hand grip 115 configured to engage the fist of the user's hand by contacting the palmar side of the inner glove directly under the users metacarpal phalangeal joint. The hand grip 115 may comprise a rigid or semi-rigid bar made of a wood, hard plastic, or polymer material. In various embodiments, the hand grip 115 may be disposed between the inner glove and the outer shell 110, or may be stitched into a pocket outside the outer shell 110.

Referring back to FIG. 1, first and second internal x-strap ends 130B and 140B may be attached to the dorsal pad 190 between the dorsal pad 190 and the exterior flexible shell at attachment points 131 and 141, respectively. The term "internal x-strap end" 130B refers to the portion of a strap that is disposed within a cavity or channel of the glove, and the term "external x-strap end" 130A refers to another portion of the same strap that exits an exit hole or opening of the cavity or channel and may be gripped and pulled by a user. In the figures, the arrows on the internal strap portions 130B and 140B indicate the direction in which these portions may be tightened. The internal strap portions 130B and 140B may not be visible at all from the outside of a glove, or they may be outlined by the stitching of channels in which the strap portions are disposed. The first internal x-strap end 130B may be configured to attach to the dorsal side of the dorsal pad at the area of the distal end of the user's ulnar metacarpal at attachment point 131, and the second internal x-strap 140B may be configured to attach to the dorsal side of the dorsal pad at the area of the distal end of the user's radial metacarpal at attachment point 141. These attachment points may be formed by stitching. The first and the second internal x-strap ends 130B and 140B are configured to cross in an x pattern across the dorsal side of the dorsal pad 190 and are configured to reversibly tighten the first and second hand straps in an x-splint 150 to compress the user's metacarpals, metacarpal phalangeal joint, and phalanges. The first and second internal x-strap ends 130B and 140B terminate in sections of straps that exit the glove on the palmar side as external x-strap ends 130A and 140A. At the ends of the external x-strap ends 130A and 140A may be first and second fasteners 145. The first and second fasteners may be removably attachable to another portion of the x-splint protection device 100, such as the wrist band 120.

FIG. 2 provides a palmar view of an embodiment of the x-splint protection glove 100 of the disclosure. In the embodiment of FIG. 2, the external x-strap ends 130A and 140A are illustrated with the first and second fasteners 145 that comprise hook and loop attachments. Other attachments, such as ties, clasps, tape, reusable sticky material, or any other suitable attachment may be used without departing from the scope of the disclosure. In this figure, the first and second fasteners 145 are not attached to the wrist band 120. As shown, external x-strap end 130A exits through an exit hole 132 and then may be guided through an upper securing loop 134. In FIG. 2, an exit hole for external x-strap end 140A is obscured from view, but is shown guided through a lower securing loop 144.

Figure 3:
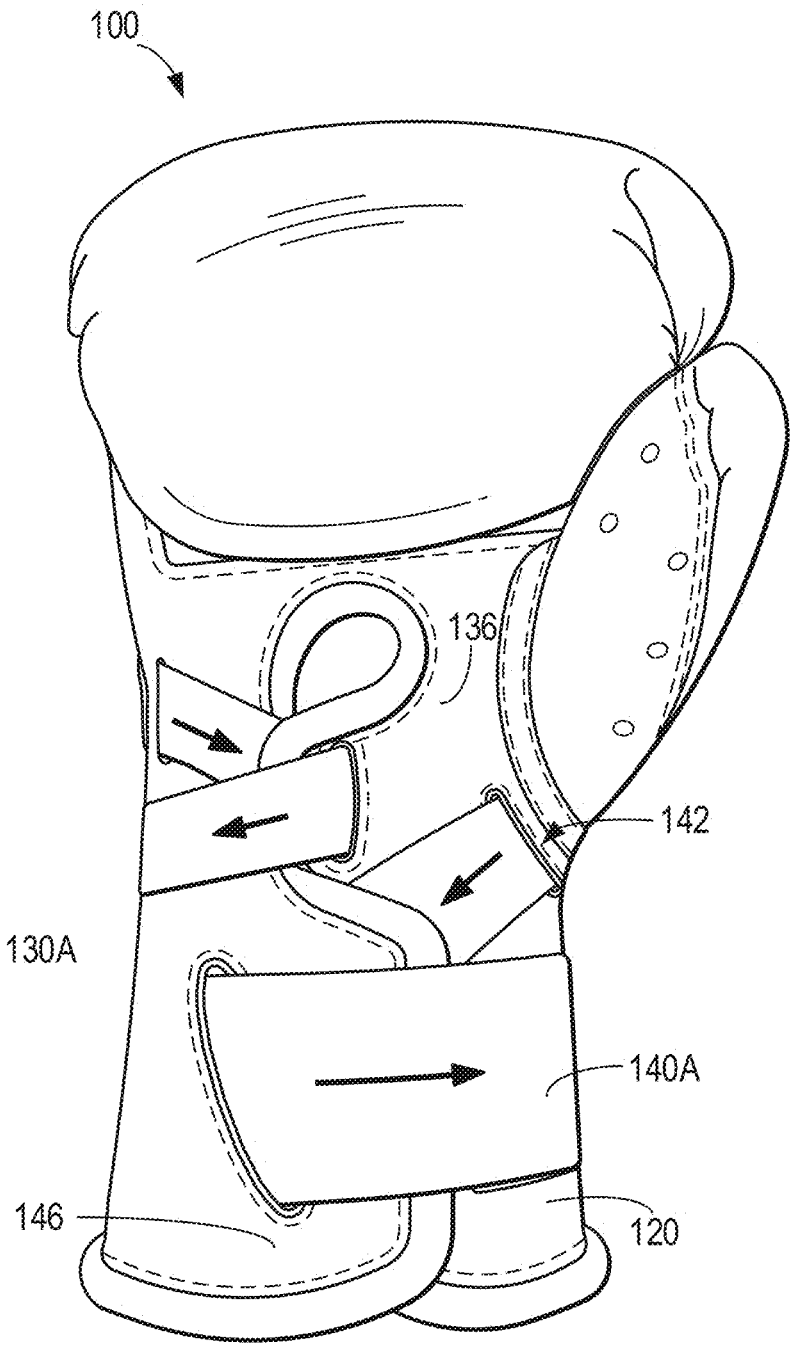
FIG. 3 provides a palmar view of an embodiment of the x-splint protection glove of the current disclosure.

FIG. 3 provides a palmar view of an embodiment of the x-splint protection glove of the disclosure. In the embodiment of FIG. 3, the first and second fasteners comprise hook and loop attachments and are attached to the wrist band 120 on the dorsal side (not shown). In the view of FIG. 3, the exit hole 142 for external strap end 140A is shown, and the external x-strap ends 130A and 140A are shown having been pulled through the upper and lower guide loops 132 and 142. The external strap ends 130A and 140A are then pulled back toward the dorsal side of the glove in the opposite directions from which they entered the respective upper and lower guide loops 132 and 142. By pulling the external x-strap ends back in the opposite directions, the upper and lower flaps 136 and 146 of the wrist band 120 may be tightened around the wrist.

Figure 4:
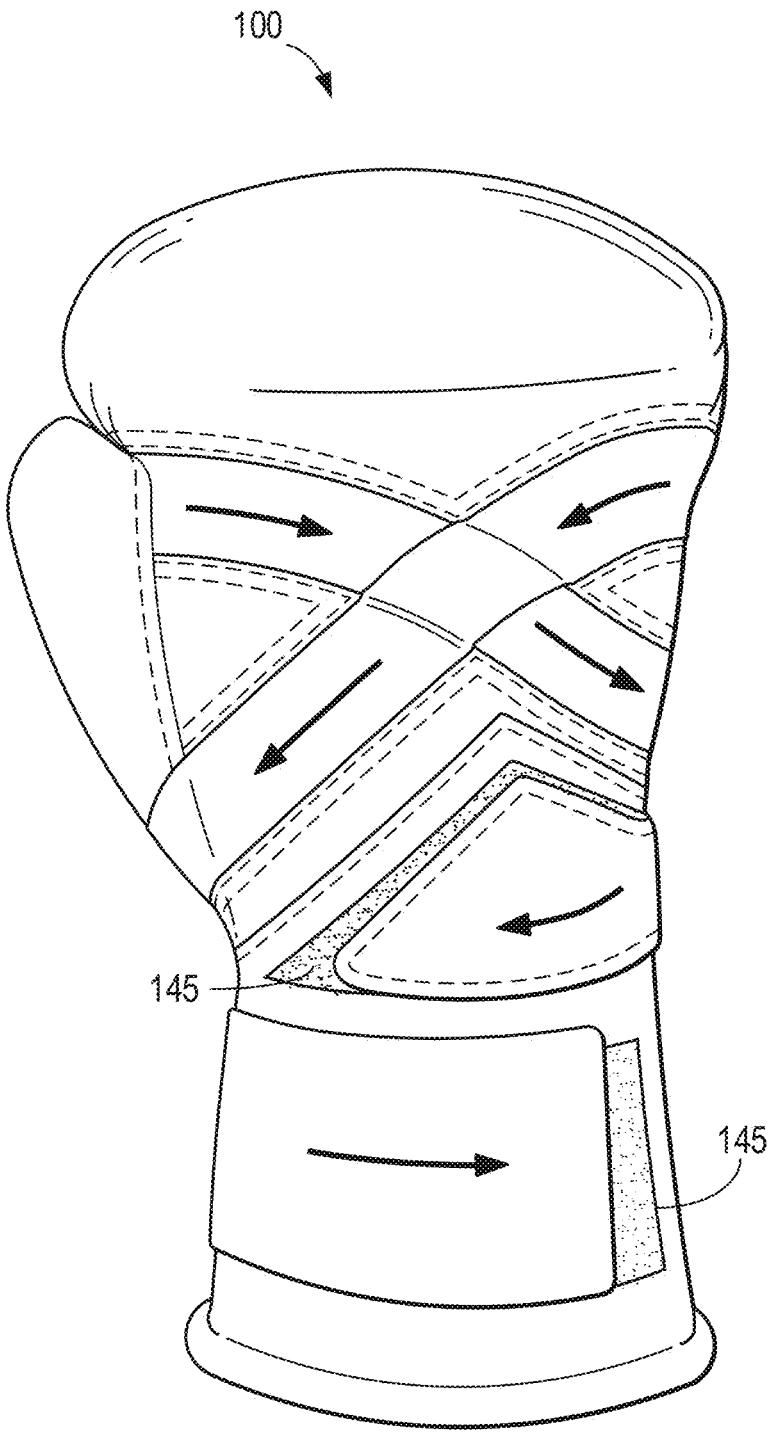
FIG. 4 provides a dorsal view of an embodiment of the x-splint protection glove of the disclosure.

FIG. 4 provides a dorsal view of an embodiment of the x-splint protection glove 100 of the disclosure with the first and second fasteners 145 are attached to the wrist band 120 on the dorsal side. This view may represent the dorsal view of the configuration of the glove 100 shown in FIG. 3. The large surface area of the hook-and-loop fasteners may provide the benefit of a secure attachment. In conjunction with the arrangement of the straps through the upper and lower guide loops 132 and 142 shown in FIG. 3, the fasteners 145 may ensure that the straps stay in place during any striking activity.

FIG. 5 provides a cutaway side view of an embodiment of the x-splint protection device of the present disclosure. As shown in FIG. 5, the x-splint protection glove 100 may comprise first 160 and second channels 170 located on the dorsal side of the dorsal pad 190 between the dorsal pad and the exterior flexible shell 110 configured to respectively contain the first 130 and second 140 hand support straps, wherein the first and second channels are configured to guide the reversible tightening of the first and second hand straps in an x-splint 150 to compress the user's metacarpals, metacarpal phalangeal joint, and phalanges. The inner glove 180 is shown in the figure. In an embodiment of the x-splint protection device, the plurality of layers comprise padding of at least one density.

In some embodiments, the striking glove of the present disclosure may be particularly suited for MMA fighting, as opposed to boxing. In certain MMA sports, such as UFC®, it is customary or required that a glove have open fingers. Such a glove may have individual pockets for each finger and the thumb, and may terminate in openings near the phalangeal knuckles. Striking gloves of these particular embodiments may have less padding, or padding of a different density, than that in the boxing glove embodiments. The x-strap and x-splint features and functions may remain substantially similar. These embodiments may not necessarily include an inner glove and an outer shell with a dorsal cavity between. Instead, the x-straps of this particular embodiment may be retained in channels formed by stitching fabric to an exterior of the dorsal side of the glove. For example, a piece of fabric in an X pattern may be stitched to the dorsal side of the glove, and cavity may be defined the piece of fabric and the dorsal surface of the glove. The straps may be retained and slide within the channels.

Figure 6:
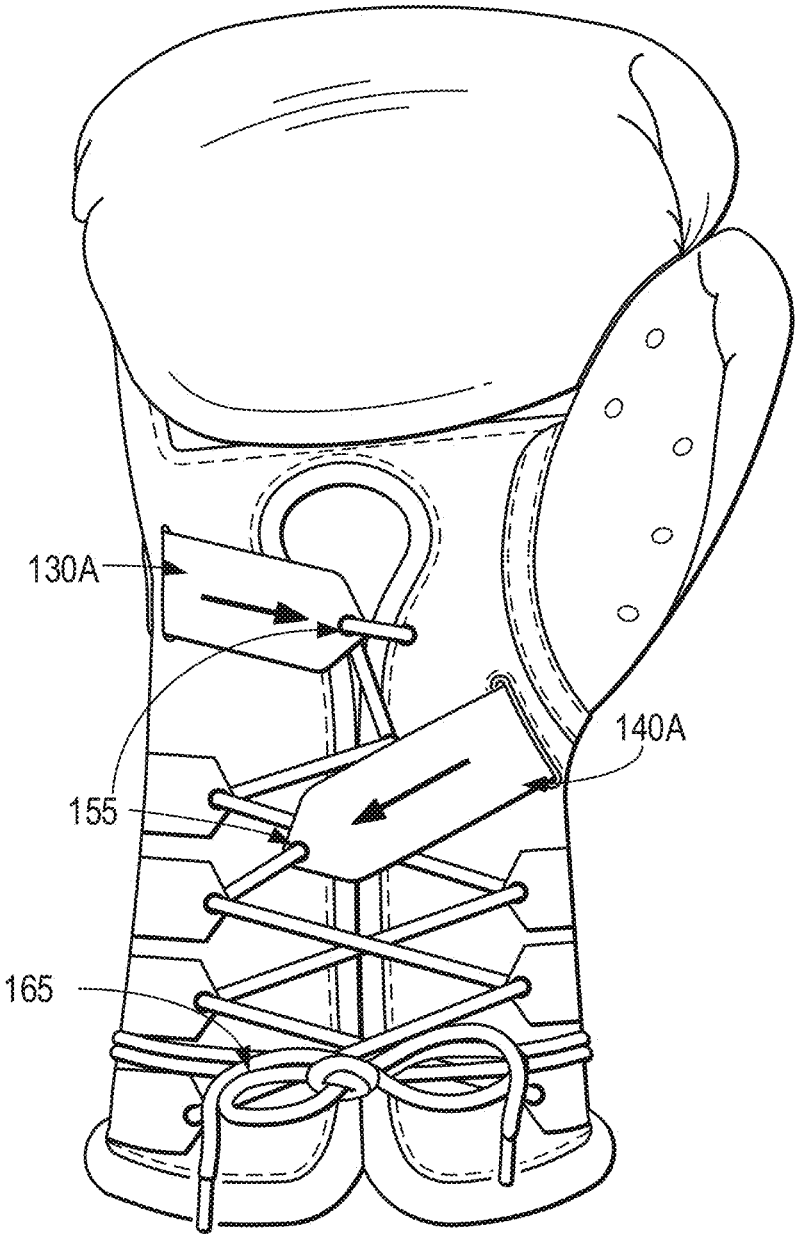
FIG. 6 provides a palmar view of an embodiment of the x-splint protection glove of the current disclosure.

FIG. 6 shows another embodiment of the x-splint protection device, in which the fasteners may comprise laces 165 at the ends of the external x-strap ends 140A and 130A. In these embodiments, lace ends 155 may be attached to the external x-strap ends 130A and 140A through a hole in the external x-strap ends or by another suitable attaching mechanism. The laces 165 may then be tied together like traditional boxing gloves, and the tying itself may cause the pulling of the external x-strap ends 130A and 140A and tighten the internal x-strap ends.

In some embodiments, the x-splint protection device may comprise a removable inner glove which itself may comprise one or more of the components of the x-splint glove described herein. The inner glove may be made out of a washable and/or absorbent material, such as neoprene. This inner glove may simply be a liner and provide extra padding or act as a barrier for sweat so that the interior of the x-splint protection device does not absorb sweat. In some embodiments, the inner glove itself may comprise some of the features, like the x-straps and/or the channels themselves, all of which may be removable from an exterior shell or padded portion of the glove. In embodiments, the inner sleeve or exterior shell may have a sticky surface, or grip enhancing materials on the plantar surface of the inner sleeve or exterior shell.

Figure 7:
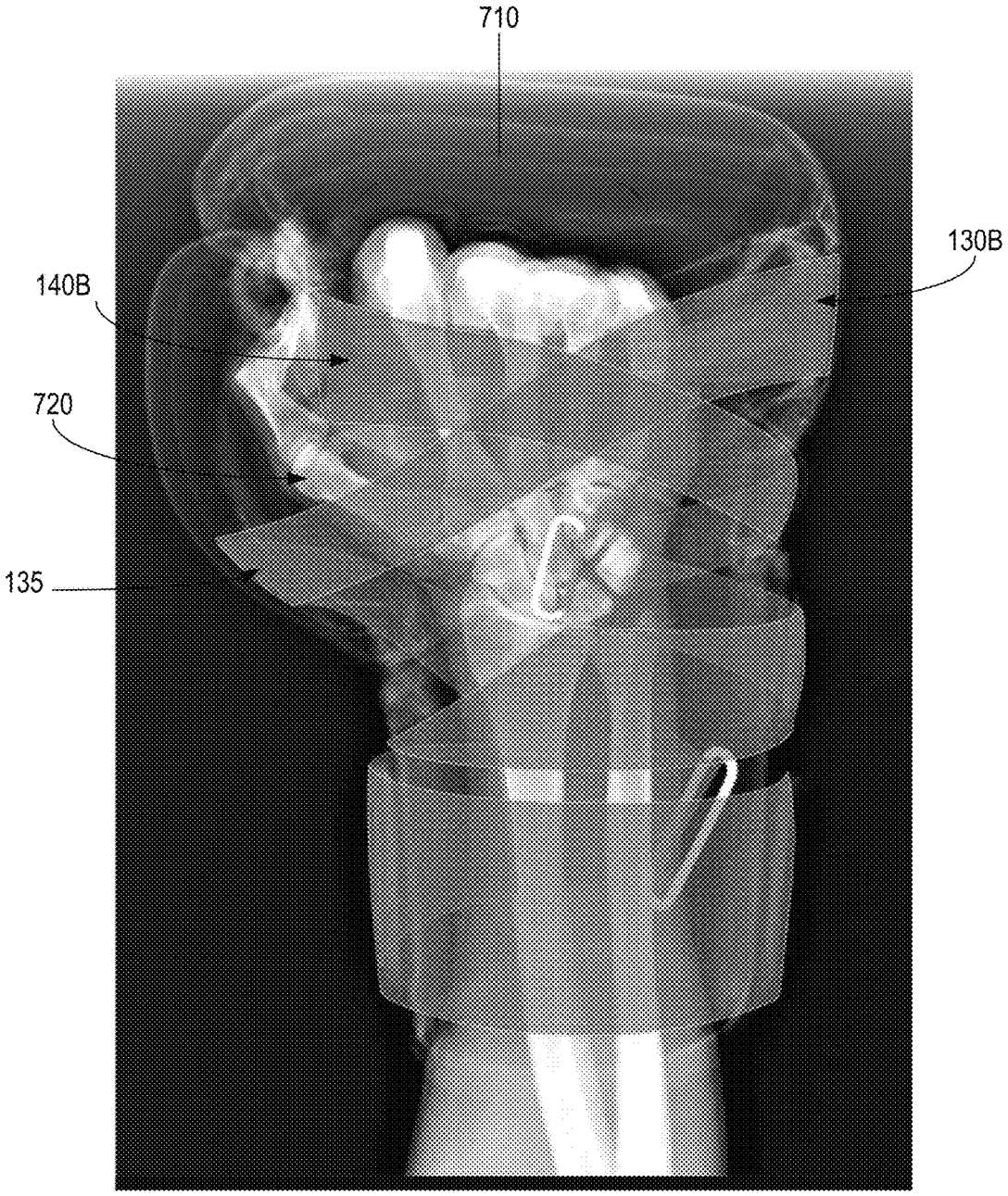
FIG. 7 provides an x-ray view of a fist in the x-splint protection glove of the present disclosure with an image of straps superimposed on the x-ray view as they are arranged in relation to the hand.

FIG. 7 shows an x-ray view of a hand and wrist positioned in an x-splint glove of the present disclosure. An image of the x-straps of the present disclosure is superimposed upon the x-ray as they would be positioned within the glove. The x-ray view shows the metacarpals 710, especially the pinky metacarpal, compressed together, which is due to the tightening of the internal x-straps 130B-140B. The x-ray view also shows the lower thumb joint 720 pulled in tightly to the rest of the hand bones, due to the internal x-strap 130B being tightened at the thumb portion 135. The wrist is also slightly angled in a proximal orientation. This x-ray view illustrates how each of the features of the x-splint protection glove of the present disclosure provide a number of advantages to the wearer to help avoid injury.

All references throughout this application are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

When a group of substituents is disclosed herein, it is understood that all individual members of those groups and all subgroups and classes that can be formed using the substituents are disclosed separately. When a Markush group or other grouping is used herein, all individual members of the group and all combinations and subcombinations possible of the group are intended to be individually included in the disclosure. As used herein, "and/or" means that one, all, or any combination of items in a list separated by "and/or" are included in the list; for example "1, 2 and/or 3" is equivalent to "'1' or '2' or '3' or '1 and 2' or '1 and 3' or '2 and 3' or '1, 2 and 3'".

Every formulation or combination of components described or exemplified can be used to practice the invention, unless otherwise stated. Specific names of materials are intended to be exemplary, as it is known that one of ordinary skill in the art can name the same material differently. One of ordinary skill in the art will appreciate that methods, device elements, starting materials, and synthetic methods other than those specifically exemplified can be employed in the practice of the invention without resort to undue experimentation. All art-known functional equivalents, of any such methods, device elements, starting materials, and synthetic methods are intended to be included in this invention.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A striking glove comprising:

an inner glove;

an outer shell; and a first strap and a second strap, wherein the first strap and the second strap are slidably disposed within at least two channels within a dorsal cavity between the inner glove and the outer shell in an overlapping and crossed configuration;

wherein the first strap and the second strap extend from the dorsal cavity to a palmar side of the striking glove; and wherein the at least two channels terminate in exit holes on the palmar side of the striking glove, and wherein one end of each of the first and second strap exit the exit holes.

2. The striking glove of claim 1, wherein the first strap and the second strap are independently moveable.

3. The striking glove of claim 1, wherein the first strap and the second strap are secured at internal ends to the striking glove within the dorsal cavity.

4. The striking glove of claim 1, wherein external ends of the first strap and the second strap are configured to fasten the straps to the striking glove.

5. The striking glove of claim 1, further comprising one or more sleeves within the dorsal cavity for constraining movement of the first and second straps.

6. The striking glove of claim 1, wherein the first strap is secured at an ulnar metacarpal position within the dorsal cavity and extends from the dorsal cavity to a radial wrist area of a palmar region, and wherein the second strap is secured at a distal radial metacarpal position within the dorsal cavity and extends from the dorsal cavity to the radial wrist area of the palmar region.

7. The striking glove of claim 1, further comprising at least one layer of padding between the inner glove and the outer shell.

8. The striking glove of claim 1, wherein the first strap and the second strap secure to a wrist band of the striking glove.

9. The striking glove of claim 8, wherein the first strap and the second strap cross at a palmar region of the striking glove and fasten on a dorsal surface of the wrist band.

10. The striking glove of claim 8, wherein the first strap and the second strap double-back at a palmar region of the striking glove and fasten on a dorsal surface of the wrist band.

11. The striking glove of claim 1, further comprising a hand grip.

12. The striking glove of claim 1, wherein at least one of the first strap or the second strap is configured to pull a portion of a thumb pocket of the glove toward the dorsal cavity.

13. A hand protection device comprising:

a glove having a dorsal side and a palmar side and configured to receive a hand;

a wrist band;

at least two channels disposed on the dorsal side of the glove arranged in an overlapping and crossed configuration; and one or more straps disposed within the at least two channels, wherein the one or more straps is configured to be retained within and slide within the at least two channels, and wherein at least a portion of one of the one or more straps crosses over another portion of the one or more straps within the channel, and wherein the at least two channels terminate in exit holes on the palmar side of the hand protection device, and wherein one end of each of the one or more straps exit the exit holes.

14. The hand protection device of claim 13, wherein the at least two channels are formed by stitching one or more pieces of material to the dorsal side of the glove, and wherein the at least two channels form a cavity between the dorsal side of the glove and the one or more pieces of material.

15. The hand protection device of claim 13, wherein the glove comprises separate pockets for each finger and thumb of the hand.

16. The hand protection device of claim 15, wherein the separate pockets for each finger terminate in openings.

* * * * *